US011810735B1

(12) United States Patent
Kuo et al.

(10) Patent No.: US 11,810,735 B1
(45) **Date of Patent: *Nov. 7, 2023**

(54) CONTROL DEVICE

(71) Applicant: Primax Electronics Ltd., Taipei (TW)

(72) Inventors: Wei-Ching Kuo, Taipei (TW); Ting-Sheng Wang, Taipei (TW); Rong-Fu Lee, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/981,273

(22) Filed: Nov. 4, 2022

(30) Foreign Application Priority Data

Sep. 26, 2022 (TW) ..... 111136416

(51) Int. Cl.
*H01H 13/702* (2006.01)
*H01H 13/02* (2006.01)
*H01H 13/20* (2006.01)
*H01H 13/14* (2006.01)

(52) U.S. Cl.
CPC ..... *H01H 13/702* (2013.01); *H01H 13/023* (2013.01); *H01H 13/14* (2013.01); *H01H 13/20* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20; H01H 13/83; H01H 2219/062; H01H 2219/039; H01H 13/023; H01H 2219/06; H01H 2221/07; H01H 9/181; H01H 2219/036; H01H 2219/044;
(Continued)

(56) References Cited

U.S. PATENT DOCUMENTS 7,164,092 B2 * 1/2007 Kawano ..... H01H 3/12 200/310
2009/0095607 A1 * 4/2009 Tatehata ..... H01H 13/83 200/314

(Continued)

*Primary Examiner* — Ahmed M Saeed
(74) *Attorney, Agent, or Firm* — KIRTON McCONKIE; Evan R. Witt

(57) ABSTRACT

A control device includes a display panel and plural key structures. Each key structure includes a keycap, an optical film layer, an elastic element, plural raised structures and a membrane switch. The optical film layer includes a light-transmissible region and a supporting region. The plural raised structures are formed on the supporting region and arranged around the light-transmissible region. The membrane switch includes an upper film layer and a lower film layer. Moreover, a light beam emitted by the display panel is transmitted upwardly through a second opening of the lower film layer, a first opening of the upper film layer, the light-transmissible region, a hollow part of the elastic element and the keycap. When the keycap is pressed down, the first circuit contact point of the upper film layer and the corresponding second circuit contact point of the lower film layer are contacted with each other.

15 Claims, 9 Drawing Sheets

(58) Field of Classification Search
CPC ..... H01H 2013/026; H01H 9/16; H01H 2219/0622; H01H 2219/037
See application file for complete search history.

(56) References Cited

U.S. PATENT DOCUMENTS

| | | | | |
|---|---|---|---|---|
| 2009/0189316 | A1* | 7/2009 | Chang | B29C 35/02 264/447 |
| 2010/0140069 | A1* | 6/2010 | Tatehata | H01H 13/83 200/512 |
| 2011/0280024 | A1* | 11/2011 | Tanabe | G02B 6/0035 362/351 |
| 2019/0172663 | A1* | 6/2019 | Yeh | H01H 13/023 |
| 2023/0223214 | A1* | 7/2023 | Pan | H01H 13/14 200/341 |

* cited by examiner

CONTROL DEVICE

FIELD OF THE INVENTION

The present invention relates to a control device, and more particularly to a control device with a display panel and at least one light-transmissible key structure.

BACKGROUND OF THE INVENTION

A control device is widely used in a live streaming machine, a live production switcher, an ordering machine or a drawing device. The control device comprises a display panel and plural light-transmissible key structures. Due to the cooperation of the display panel and the light-transmissible key structures, the control device has the visualized buttons for facilitating the user to select desired items and perform associated operations in an intuitive manner.

In the conventional control device, the key structure needs to be light-transmissible for allowing the image or the light beam from the underlying display panel to pass through. For achieving the above purposes, the membrane switch of the key structure needs to have a hollow portion. Due to the hollow portion of the key structure, it is difficult to install a proper spacer layer between an upper film layer and a lower film layer of the membrane switch. Moreover, the arrangement of the hollow portion in the middle region of the key structure of the control device also results in some problems. For example, when the key structure is pressed down by the user, the pressing force is usually applied to an edge or a corner of a keycap of the key structure. Consequently, the underlying membrane switch is unable to be effectively triggered.

In other words, the design of the control device needs to be further improved.

SUMMARY OF THE INVENTION

In order to overcome the drawbacks of the conventional technologies, the present invention provides a control device. The key structure of the control device is specially designed. Consequently, a spacer layer between an upper film layer and a lower film layer of a membrane switch of the key structure can be installed more easily. Moreover, the membrane switch can be triggered more effectively, and the problem of erroneously triggering the membrane switch can be avoided.

In accordance with an aspect of the present invention, a control device is provided. The control device includes a display panel and plural key structures. The plural key structures are located over the display panel. Each of the plural key structures includes a keycap, an optical film layer, an elastic element, plural raised structures and a membrane switch. The keycap is light-transmissible. The optical film layer includes a light-transmissible region and a supporting region. The elastic element is arranged between the keycap and the optical film layer. The elastic element includes a support part, a first lateral wall, a first lower part and a hollow part. The support part, the first lateral wall and the first lower part are arranged around the hollow part. The support part is connected with the keycap. The first lateral wall is arranged between the support part and the first lower part. The plural raised structures are formed on the supporting region of the optical film layer and arranged around the light-transmissible region of the optical film layer. The membrane switch is located under the optical film layer. The membrane switch includes an upper film layer, a lower film layer and at least one ink layer. The upper film layer includes a first top surface, a first opening, a first bottom surface and plural first circuit contact points. The lower film layer includes a second top surface, a second opening, a second bottom surface and plural second circuit contact points. The first opening runs through the first top surface and the first bottom surface. The first bottom surface faces the lower film layer. The plural first circuit contact points are formed on the first bottom surface. The second opening runs through the second top surface and the second bottom surface. The second top surface faces the upper film layer. The plural second circuit contact points are formed on the second top surface. Moreover, a light beam emitted by the display panel is transmitted upwardly through the second opening, the first opening, the light-transmissible region, the hollow part and the keycap. The at least one ink layer is formed on the first bottom surface or the second top surface. The upper film layer and the lower film layer are separated from each other through the at least one ink layer. Each of the at least one ink layer includes plural indented regions. The plural raised structures, the corresponding first circuit contact points, the corresponding indented regions and the corresponding second circuit contact points are aligned with each other along a vertical direction. When the keycap is pressed down, the keycap or the support part of the elastic element is moved downwardly to push at least one raised structure of the plural raised structures. Consequently, the first circuit contact point corresponding to the pushed raised structure and the second circuit contact point corresponding to the pushed raised structure are contacted with each other.

In an embodiment, the light-transmissible region of the optical film layer is a rectangular opening with four corners and four edges. In each of the plural key structures, each of the four corners and the four edges of the light-transmissible region is located near at least one corresponding raised structure of the plural raised structures.

In an embodiment, the first opening is a rectangular opening with four corners and four edges. In each of the plural key structures, each of the four corners and the four edges of the first opening is located near at least one corresponding first circuit contact point of the plural first circuit contact points.

In an embodiment, the first opening is a rectangular opening with four corners and four edges. Moreover, each of the four corners and the four edges of the first opening is located near at least one corresponding indented region of the plural indented regions of the corresponding ink layer.

In an embodiment, an coverage area of each indented region is larger than an coverage area of the corresponding first circuit contact point. Consequently, the corresponding first circuit contact point is permitted to be contacted with the underlying second circuit contact point through the corresponding indented region.

In an embodiment, each indented region has an arc-shaped notch.

In an embodiment, the second opening is a rectangular opening with four corners and four edges. In each of the plural key structures, each of the four corners and the four edges of the second opening is located near at least one corresponding second circuit contact point of the plural second circuit contact points.

In an embodiment, the second opening is a rectangular opening with four corners and four edges. Moreover, each of the four corners and the four edges of the second opening is located near at least one corresponding indented region of the plural indented regions of the corresponding ink layer.

In an embodiment, the at least one ink layer is formed on the first bottom surface or the second top surface by using a UV printing process.

In an embodiment, the at least one ink layer includes a first ink layer and a second ink layer. The first ink layer is formed on the first bottom surface. The second ink layer is formed on the second top surface. The first ink layer and the second ink layer are contacted with each other along the vertical direction.

In an embodiment, the at least one ink layer includes a first ink layer and a second ink layer. The first ink layer is formed on the first bottom surface. The second ink layer is formed on the second top surface. The first ink layer and the second ink layer are combined together through an adhesive layer.

In an embodiment, the optical film layer is a light-shielding sheet, and the light-transmissible region of the optical film layer is a hollow structure.

In an embodiment, the raised structures are made of rubber, epoxy resin or polyester resin.

In an embodiment, the raised structures are formed by using an attaching process, a printing process, a coating process, a glue dispensing process or an integral formation process.

In an embodiment, the keycap includes a press part, a second lateral wall and a second lower part. The second lateral wall is arranged between the press part and the second lower part. The second lower part is downwardly contacted with the support part of the elastic element. When the keycap is pressed down, the support part of the elastic element is moved downwardly to push at least one raised structure of the plural raised structures.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
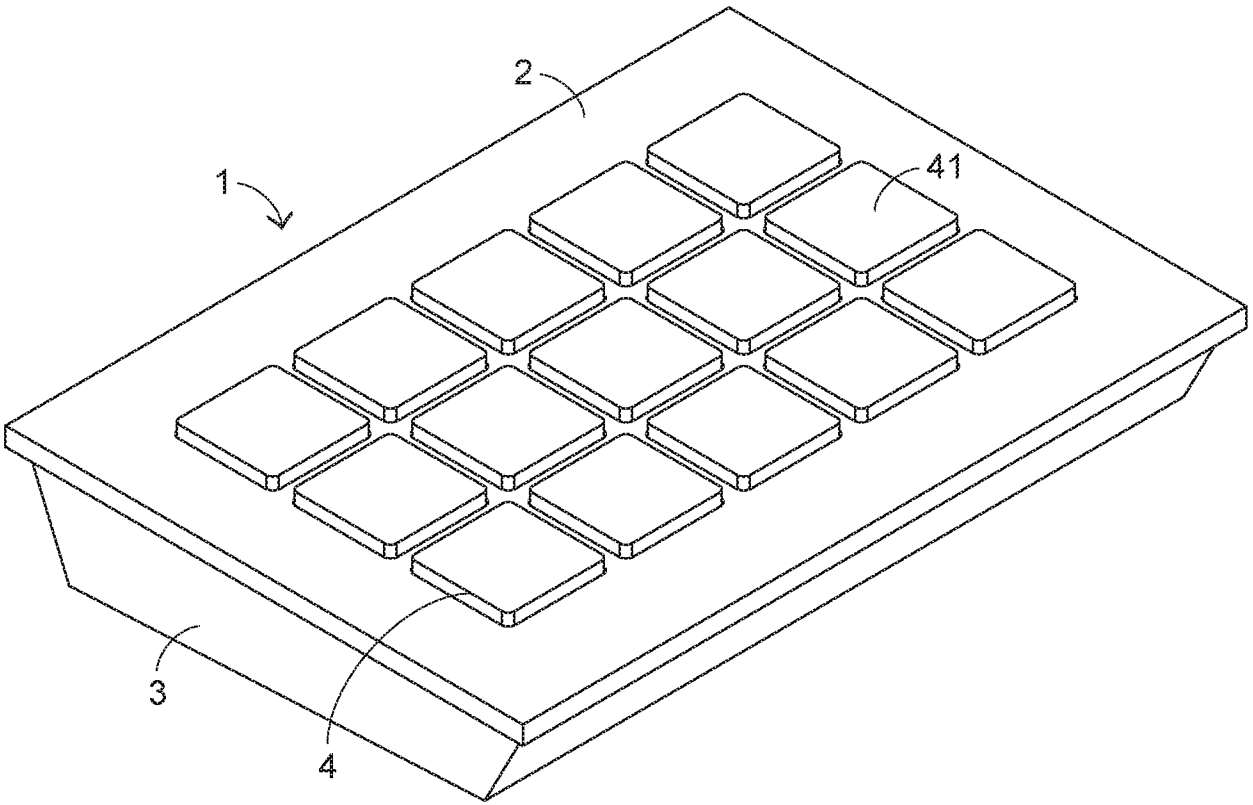
FIG. 1 is a schematic perspective view illustrating the assembled structure of a control device according to a first embodiment of the present invention.
Figure 2:
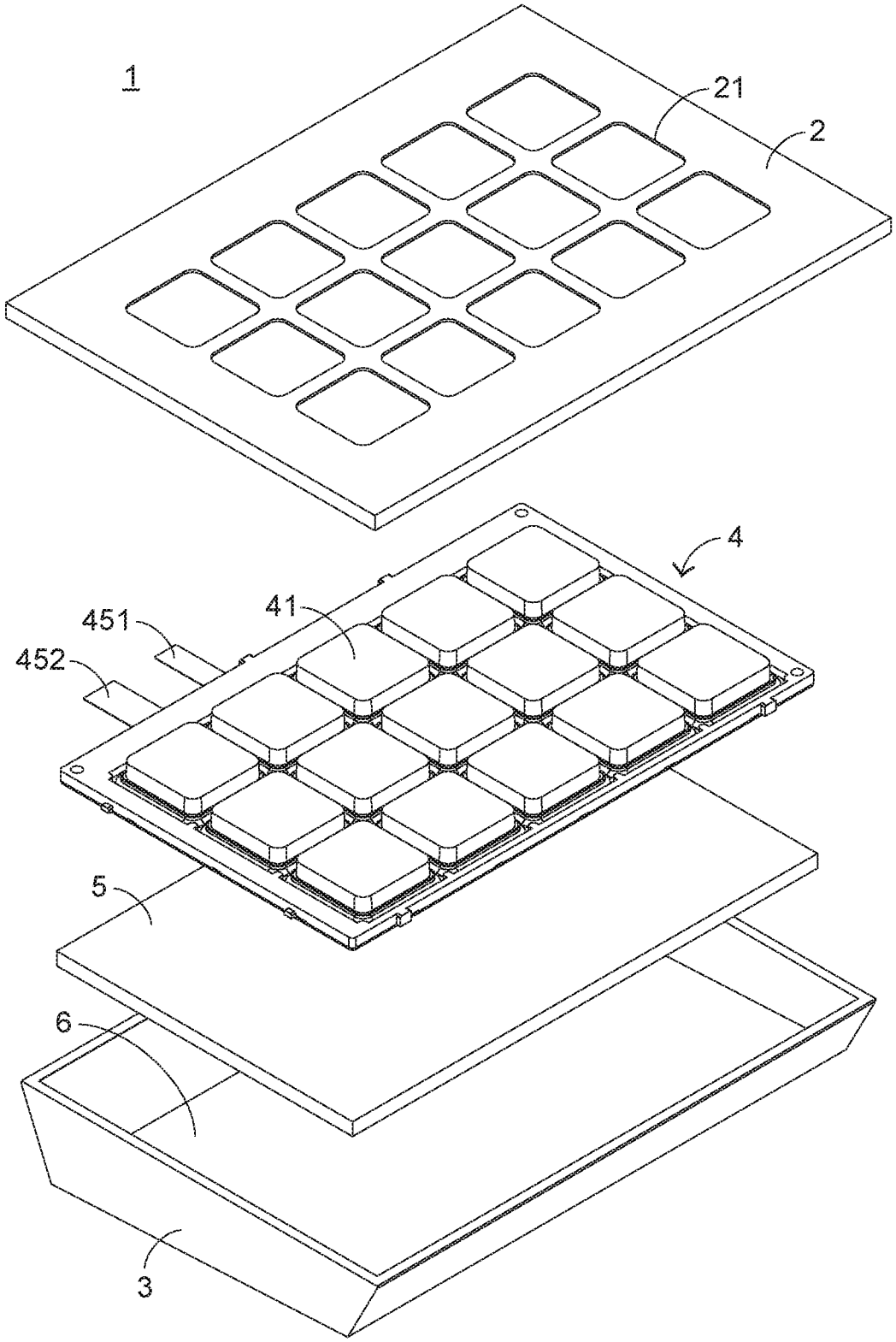
FIG. 2 is a schematic exploded view illustrating the control device as shown in FIG. 1.
Figure 3:
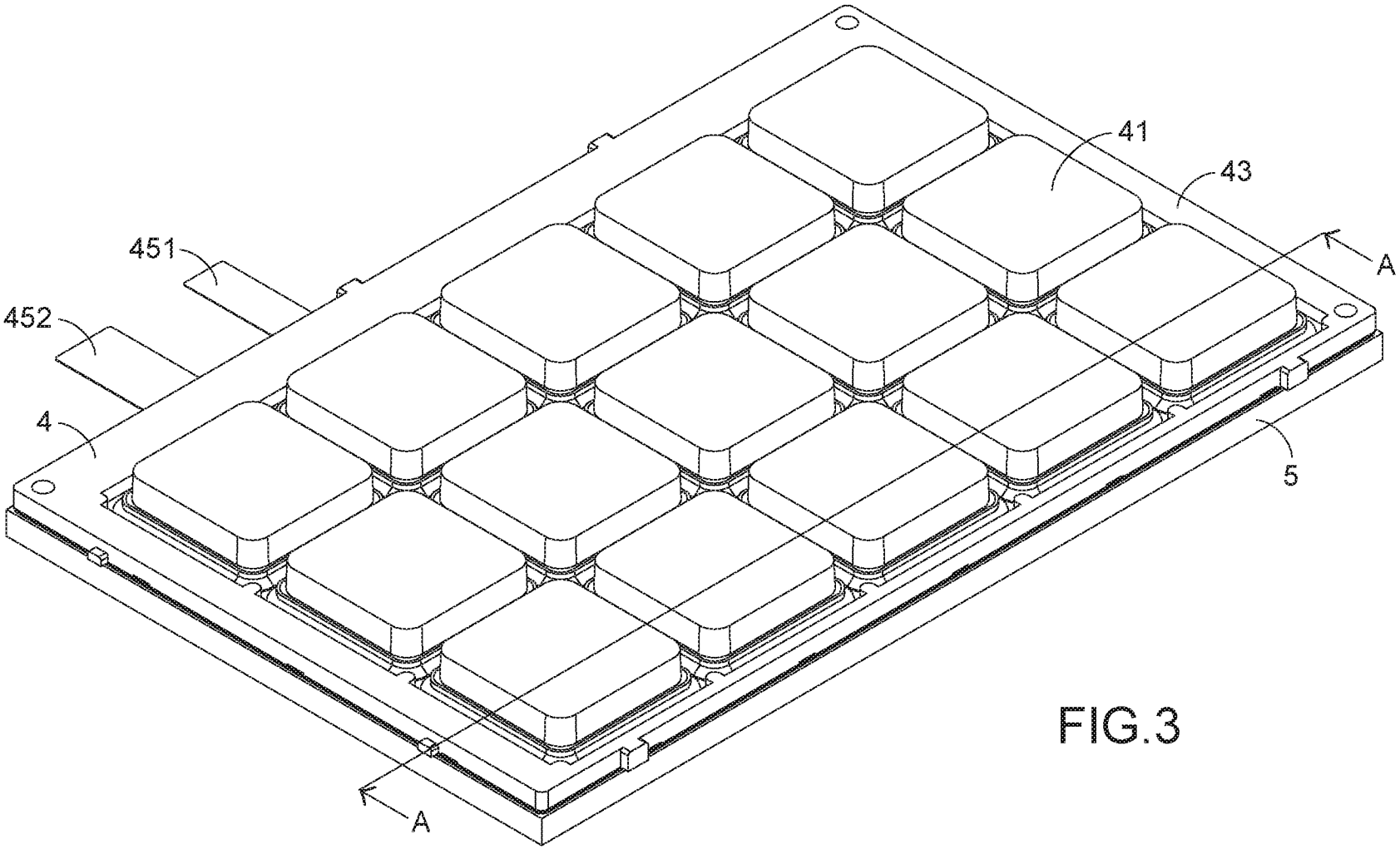
FIG. 3 is a schematic perspective view illustrating a display panel and plural key structures of the control device as shown in FIG. 2.
Figure 4:
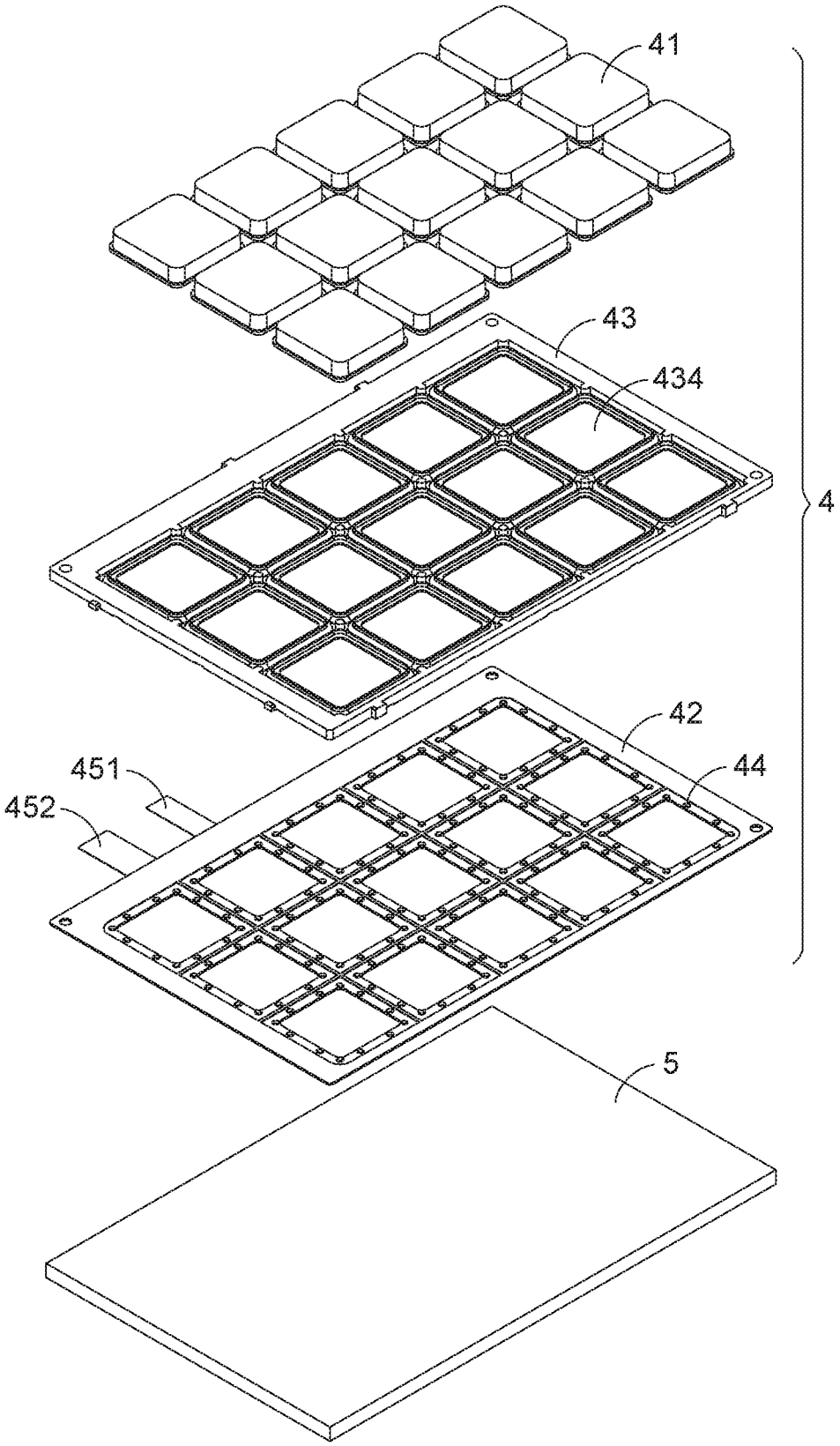
FIG. 4 is a schematic exploded view illustrating the display panel and the plural key structures as shown in FIG. 3.
Figure 5:
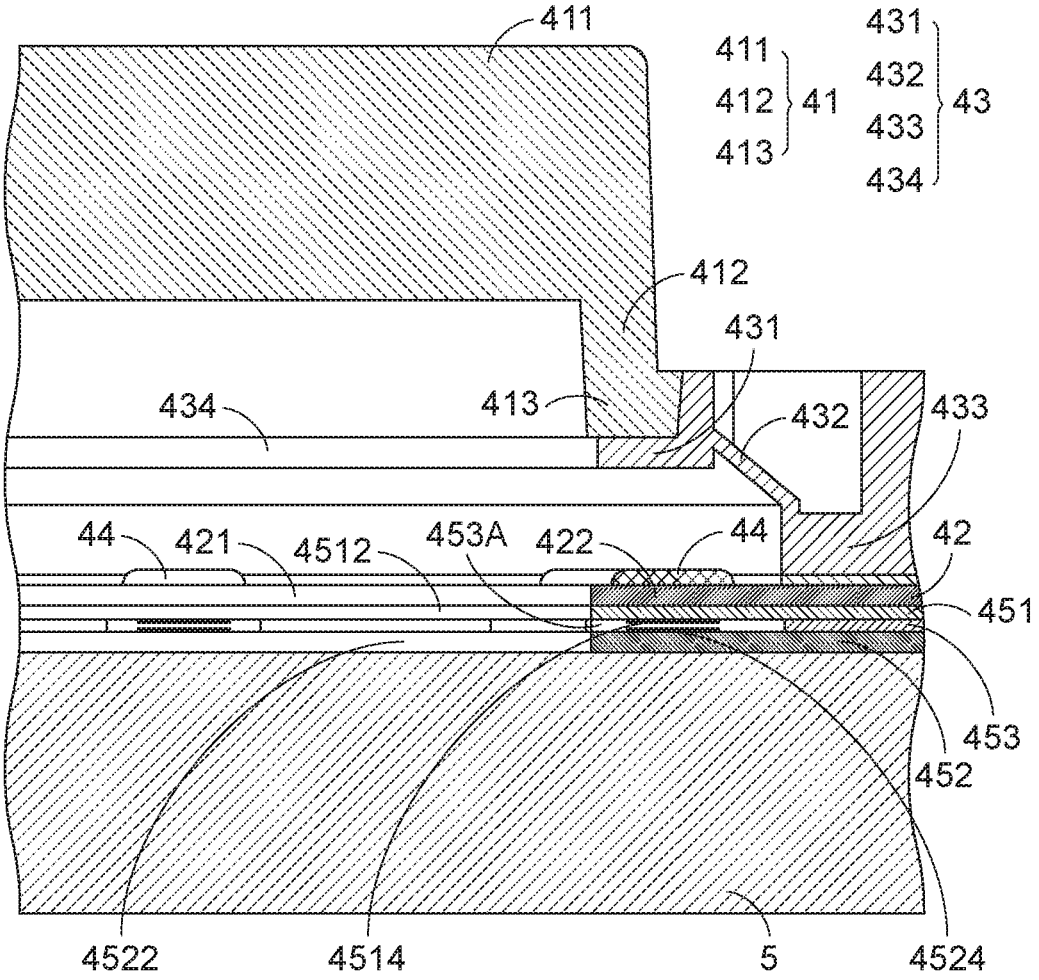
FIG. 5 is a schematic cross-sectional view illustrating portions of the display panel and the key structure as shown in FIG. 3 and taken along the line A-A.
Figure 6:
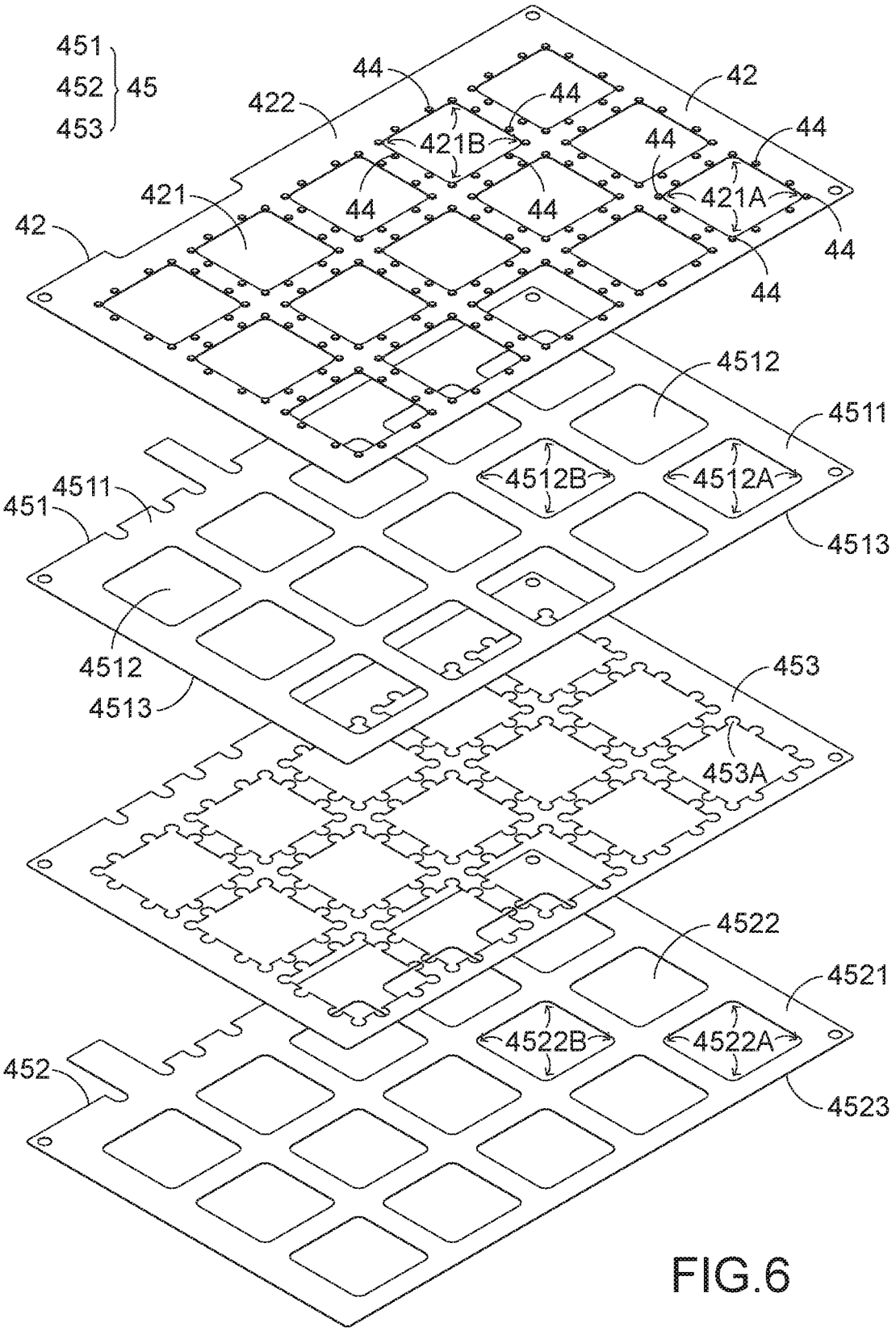
FIG. 6 is a schematic exploded view illustrating the optical film layers and the membrane switches of the key structures as shown in FIG. 4.
Figure 7:
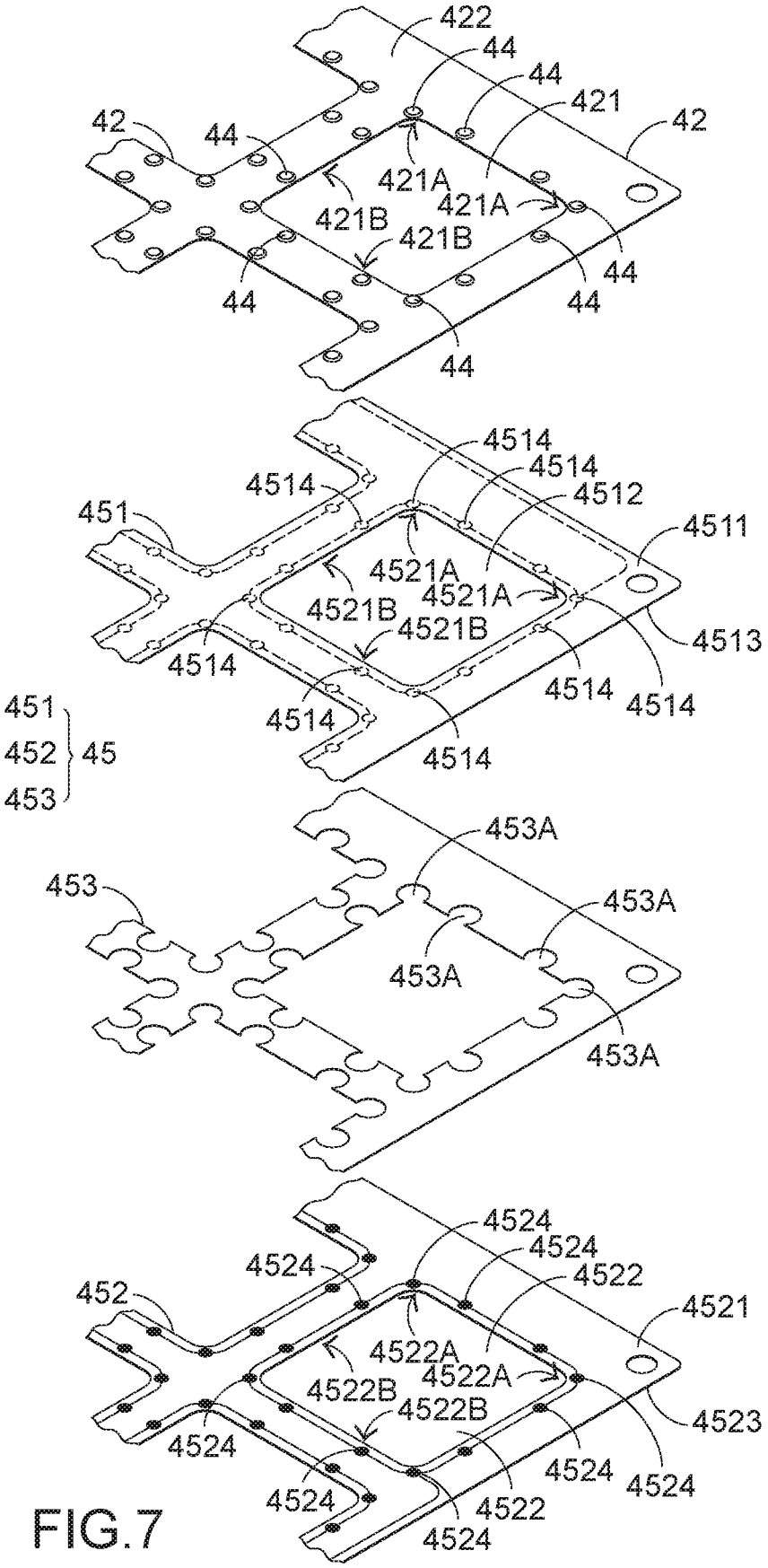
FIG. 7 is a schematic enlarged view illustrating portions of the optical film layers and the membrane switches as shown in FIG. 6.
Figure 8:
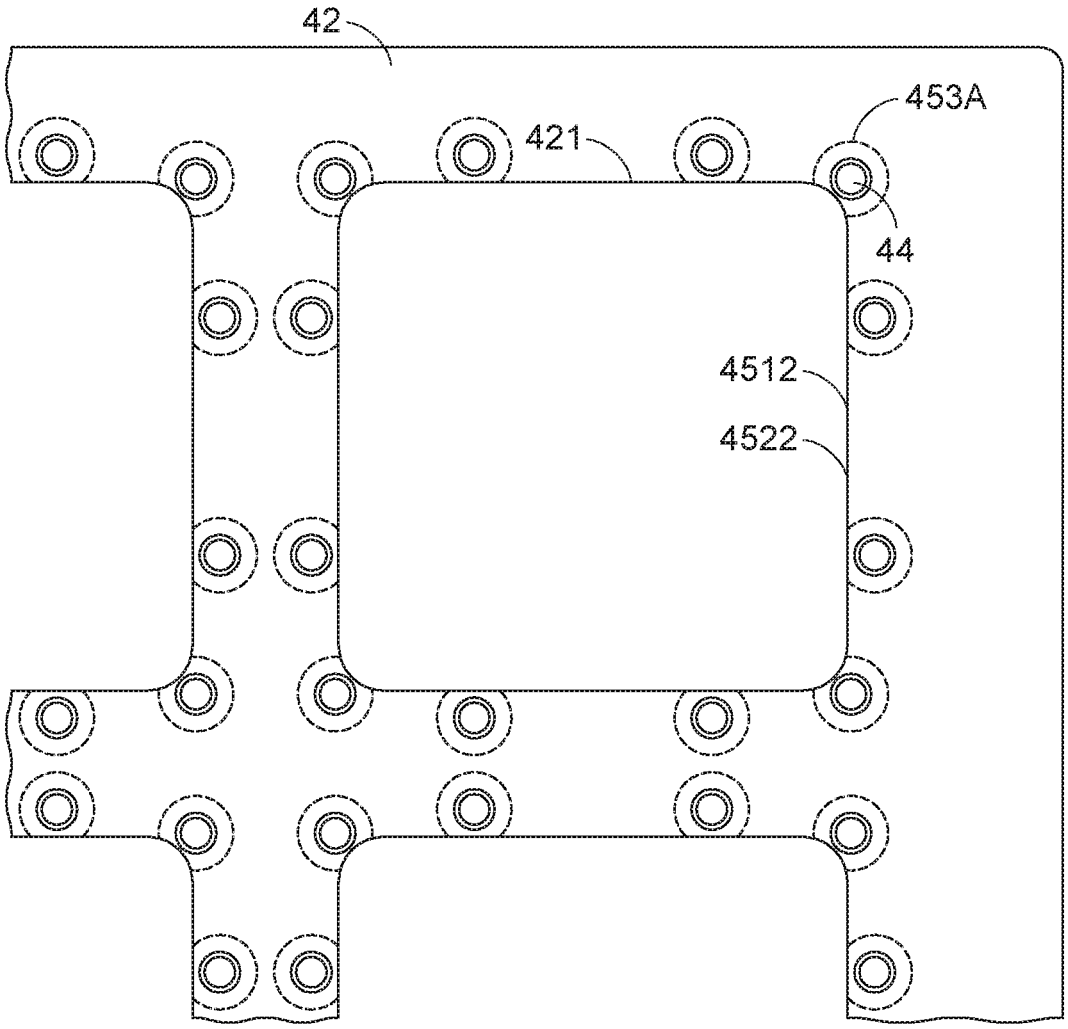
FIG. 8 is a schematic top view illustrating the portions of the optical film layers and the membrane switches as shown in FIG. 7.

Please refer to FIGS. 1 to 8. FIG. 1 is a schematic perspective view illustrating the assembled structure of a control device according to a first embodiment of the present invention. FIG. 2 is a schematic exploded view illustrating the control device as shown in FIG. 1. FIG. 3 is a schematic perspective view illustrating a display panel and plural key structures of the control device as shown in FIG. 2. FIG. 4 is a schematic exploded view illustrating the display panel and the plural key structures as shown in FIG. 3. FIG. 5 is a schematic cross-sectional view illustrating portions of the display panel and the key structure as shown in FIG. 3 and taken along the line A-A. FIG. 6 is a schematic exploded view illustrating the optical film layers and the membrane switches of the key structures as shown in FIG. 4. FIG. 7 is a schematic enlarged view illustrating portions of the optical film layers and the membrane switches as shown in FIG. 6. FIG. 8 is a schematic top view illustrating the portions of the optical film layers and the membrane switches as shown in FIG. 7.

The control device can be applied to a live streaming machine, a live production switcher, an ordering machine or a drawing device.

In this embodiment, the control device 1 comprises a top cover 2, an outer casing 3, plural key structures 4 and a display panel 5.

An accommodation space 6 is defined by the top cover 2 and the outer casing 3 collaboratively. The plural key structures 4 and the display panel 5 are disposed within the accommodation space 6. Optionally, a processor, a signal processing device, a communication interface and a circuit board are disposed within the control device 1 in order to support the key structures 4 and the display panel 5.

According to the predetermined setting or control, different images, information or pictures generated by the display panel 5 can be shown on individual key regions of the key structures 4. Consequently, after a specified key structure 4 is selected and pressed down by the user, the control device 1 issues a control signal corresponding to the image, the information or the picture. Moreover, the image, the information or the picture that is defined according to the light beam from the display panel 5 can be set, controlled or changed by the user.

As shown in FIG. 2, the top cover 2 comprises plural perforations 21. The positions of the perforations 21 are aligned with the positions of the plural key structures 4. In addition, the sizes of the perforations 21 match the sizes of the corresponding key structures 4. Consequently, the plural key structures 4 can be exposed outside the corresponding perforations 21 in order to be pressed or operated by the user.

Please refer to FIGS. 2 to 8 again. The plural key structures 4 are located over the display panel 5. Each of the plural key structures 4 comprises a keycap 41, an optical film layer 42, an elastic element 43, plural raised structures 44 and a membrane switch 45.

The keycap 41 is made of a light-transmissible material. Consequently, the keycap 41 has the light-transmissible property. The image, the information or the picture generated by the display panel 5 is transmitted upwardly through the keycap 41 so as to be viewed by the user. In an embodiment, the keycap 41 comprises a press part 411, a second lateral wall 412 and a second lower part 413. The second lateral wall 412 is arranged between the press part 411 and the second lower part 413.

The optical film layer 42 is arranged between the elastic elements 43 and the membrane switches 45. In an embodiment, the optical film layer 42 is a light-shielding sheet for sheltering a specified region or area. For example, the region between the adjacent key structures 4 is sheltered by the optical film layer 42, or other regions of the control device 1 required to be subjected to the light-shielding function or the light-leakage preventing function are shielded by the optical film layer 42. Due to the arrangement of the optical film layer 42, the area of the image, the information or the picture shown on each key structure 4 is clearer. Moreover, the optical film layer 42 comprises a light-transmissible region 421 and a supporting region 422. The light-transmissible region 421 is a hollow structure. The light beam emitted by the display panel 5 can be transmitted upwardly through the light-transmissible region 421 of the optical film layer 42. Preferably but not exclusively, the optical film layer 42 has a single-layered structure or a multi-layered structure. Optionally, the key structure 4 is equipped with additional film layers to provide different effects or functions.

In the key structure 4 of this embodiment, the plural raised structures 44 are formed on the supporting region 422 of the optical film layer 42, and the plural raised structures 44 are arranged around the light-transmissible region 421 of the optical film layer 42. The arrangement of the raised structures 44 facilitates the user to trigger the underlying membrane switch 45 more easily and precisely when the keycap 41 is pressed down. Preferably but not exclusively, the raised structures 44 are made of rubber, epoxy resin or polyester resin. Moreover, in an embodiment, the raised structures 44 are formed on the optical film layer 42 through an attaching process, a printing process, a coating process or a glue dispensing process. Alternatively, the raised structures 44 are integrally formed with the optical film layer 42. In other words, when the optical film layer 42 is formed or produced, the raised structures 44 are simultaneously formed on the optical film layer 42 through an integral formation process.

In the key structure 4 of this embodiment, the light-transmissible region 421 of the optical film layer 42 is a rectangular opening in shape. The light-transmissible region 421 has four corners 421A and four edges 421B. When the raised structures 44 are formed on the optical film layer 42 of the key structure 4, each corner 421A of the light-transmissible region 421 of the optical film layer 42 is located near at least one corresponding raised structure 44, and each edge 421B of the light-transmissible region 421 of the optical film layer 42 is located near at least one corresponding raised structure 44. In this embodiment, each corner 421A of the light-transmissible region 421 of the optical film layer 42 is located near one corresponding raised structure 44, and each edge 421B of the light-transmissible region 421 of the optical film layer 42 is located near two corresponding raised structures 44. It is noted that the example is not restricted.

The elastic element 43 is arranged between the keycap 41 and the optical film layer 42. The elastic element 43 has the elastic property. For example, the elastic element 43 is made of rubber. After the elastic element 43 is combined with the keycap 41, the elastic element 43 provides an elastic force for moving upwardly and downwardly the keycap 41 in a reciprocating manner. In an embodiment, the elastic element 43 comprises a support part 431, a first lateral wall 432, a first lower part 433 and a hollow part 434. The support part 431, the first lateral wall 432 and the first lower part 433 of the elastic element 43 are arranged around the hollow part 434 in the middle region of the elastic element 43. Consequently, the light beam emitted by the display panel 5 can be transmitted upwardly through the hollow part 434. The support part 431 is connected with the keycap 41. In addition, the keycap 41 is supported by the support part 431. For example, the support part 431 is contacted with a lateral side of the keycap 41. Alternatively, as shown in FIG. 5, the second lower part 413 of the keycap 41 is downwardly contacted with the support part 431 of the elastic element 43. In this embodiment, the support part 431 of the elastic element 43 is extended inwardly in the direction toward the hollow part 434. Consequently, the second lower part 413 of the keycap 41 is contacted with or supported on the support part 431 of the elastic element 43. It is noted that the example is not restricted.

For example, in this embodiment, the second lower part 413 of the keycap 41 is downwardly contacted with the support part 431 of the elastic element 43. When the keycap 41 is pressed down, the second lower part 413 of the keycap 41 is firstly moved downwardly to push the underlying support part 431 of the elastic element 43, and then the support part 431 of the elastic element 43 is moved downwardly to push the at least one raised structure 44 on the optical film layer 42.

In an embodiment, the elastic elements 43 of the plural key structures 4 are integrated as an integral elastic film layer. In other words, the plural elastic elements 43 comprises plural support parts 431 and plural first lateral walls 432 corresponding to the plural keycaps 41. Moreover, the plural first lower part 433 are connected with each other. It is noted that numerous modifications may be made while retaining the teachings of the present invention. For example, in another embodiment, the plural elastic elements 43 are individual structures rather than the integral structure. That is, each elastic element 43 corresponding to a single keycap 41. For example, each elastic element 43 has the corresponding support part 431, the corresponding first lateral wall 432 and the corresponding first lower part 433.

The first lateral wall 432 of the elastic element 43 is bendable or compressible. Consequently, the elastic element 43 can be subjected to deformation and returned to its original position. The first lower part 433 of the elastic element 43 is upwardly connected with the top cover 2 or contacted with the bottom surface of the top cover 2. Moreover, the first ii lower part 433 of the elastic element 43 is downwardly contacted with the optical film layer 42.

The membrane switch 45 is located under the optical film layer 42. In an embodiment, the membrane switch 45 comprises an upper film layer 451, a lower film layer 452 and an ink layer 453. When the membrane switch 45 is triggered, the membrane switch 45 issues a pressing signal. In an embodiment, the membrane switches 45 of the plural key structures 4 are integrated as an integral membrane structure. That is, the integral membrane structure of the membrane switches 45 is shared by the plural key structures 4.

The upper film layer 451 comprises a first top surface 4511, a first opening 4512, a first bottom surface 4513 and plural first circuit contact points 4514. The first top surface 4511 is located under the optical film layer 42. The first opening 4512 runs through the first top surface 4511 and the first bottom surface 4513. The first bottom surface 4513 faces the lower film layer 452. The plural first circuit contact points 4514 are formed on the first bottom surface 4513.

In the key structure 4 of this embodiment, the first opening 4512 of the upper film layer 451 is a rectangular opening in shape. The first opening 4512 has four corners 4512A and four edges 4512B. When the plural first circuit contact points 4514 are formed on the upper film layer 451 of the key structure 4, each corner 4512A of the first opening 4512 is located near at least one corresponding first circuit contact point 4514, and each edge 4512B of the first opening 4512 is located near at least one corresponding first circuit contact point 4514. In this embodiment, each corner 4512A of the first opening 4512 is located near one corresponding first circuit contact point 4514, and each edge 4512B of the first opening 4512 is located near two corresponding first circuit contact points 4514. It is noted that the example is not restricted.

The lower film layer 452 comprises a second top surface 4521, a second opening 4522, a second bottom surface 4523 and plural second circuit contact points 4524. The second opening 4522 runs through the second top surface 4521 and the second bottom surface 4523. The second top surface 4521 faces the second upper film layer 451. The plural second circuit contact points 4524 are formed on the second top surface 4521.

In the key structure 4 of this embodiment, the second opening 4522 of the lower film layer 452 is a rectangular opening in shape. The second opening 4522 has four corners 4522A and four edges 4522B. When the plural second circuit contact points 4524 are formed on the lower film layer 452 of the key structure 4, each corner 4522A of the second opening 4522 is located near at least one corresponding second circuit contact point 4524, and each edge 4522B of the second opening 4522 is located near at least one corresponding second circuit contact point 4524. In this embodiment, each corner 4522A of the second opening 4522 is located near one corresponding second circuit contact point 4524, and each edge 4522B of the second opening 4522 is located near two corresponding second circuit contact points 4524. It is noted that the example is not restricted.

The light beam emitted by the display panel 5 can be transmitted upwardly through the second opening 4522 of the lower film layer 452, the first opening 4512 of the upper film layer 451, the light-transmissible region 421 of the optical film layer 42, the hollow part 434 of the elastic element 43 and the keycap 41.

The plural first circuit contact points 4514 on the upper film layer 451 and the corresponding second circuit contact points 4524 on the lower film layer 452 are aligned with each other along the vertical direction. In case that the membrane switch 45 is not triggered or pressed, there is a gap or a distance between each first circuit contact point 4514 and the corresponding second circuit contact point 4524.

In the membrane switch 45 of this embodiment, the ink layer 453 is formed on the first bottom surface 4513 of the upper film layer 451 or the second top surface 4521 of the lower film layer 452 by a UV printing process and then cured. Consequently, the ink layer 453 is used as a spacer layer between the upper film layer 451 and the lower film layer 452. In accordance with the conventional technology, the film-type spacer sheet is formed through a die punching process. Consequently, the size of the spacer sheet is limited, and adjacent space sheets are in contact with or communication with each other in appearance. According to the present invention, the ink layer 453 is formed by using the UV printing process. Consequently, the layout area of the ink layer 453 will not be restricted. In other words, the ink layer 453 formed by using the UV printing process is suitably applied to the membrane switch where the upper film layer 451 or the lower film layer 452 has plural openings and the space between the adjacent openings is very narrow. Moreover, the use of the UV printing process to form the ink layer 453 can reduce the complexity of aligning and assembling the layers of the membrane switch 45.

In the membrane switch 45 of this embodiment, the ink layer 453 is formed on the first bottom surface 4513 of the upper film layer 451 or the second top surface 4521 of the lower film layer 452, and the ink layer 453 is used as the spacer layer between the upper film layer 451 and the lower film layer 452. As mentioned above, the first opening 4512 of the upper film layer 451 is a rectangular opening with four corners 4512A and four edges 4512B. In this embodiment, the ink layer 453 comprises plural indented regions 453A. In case that the ink layer 453 is formed on the first bottom surface 4513 of the upper film layer 451, each corner 4512A of the first opening 4512 is located near at least one indented region 453A of the ink layer 453, and each edge 4512B of the first opening 4512 is located near at least one indented region 453A of the ink layer 453. In this embodiment, each corner 4512A of the first opening 4512 is located near one indented region 453A, and each edge 4512B of the first opening 4512 is located near two indented regions 453A. It is noted that the example is not restricted.

Moreover, the coverage area of the indented region 453A is larger than the coverage area of the first circuit contact point 4514. Consequently, the first circuit contact point 4514 of the upper film layer 451 can be contacted with the underlying second circuit contact point 4524 of the lower film layer 452 through the corresponding indented region 453A. In an embodiment, the indented region 453A has an arc-shaped notch or a circular profile. Generally, as the indented region 453A is closer to the first opening 4512, the difficulty of forming the complete indented region 453A in the ink layer 453 is increased. Consequently, the formation of the notch in the indented region 453A can meet the specifications and sizes of certain products. Since this design is helpful for forming the ink layer 453 that is relatively broken or has an irregular shape, the advantage of forming the ink layer 453 by using the UV printing process is highlighted.

Similarly, in case that the ink layer 453 is formed on the second top surface 4521 of the lower film layer 452, each corner 4512A of the second opening 4522 is located near at least one corresponding indented region 453A of the ink layer 453, and each edge 4522B of the second opening 4522 is located near at least one corresponding indented region 453A of the ink layer 453. Moreover, the coverage area of the indented region 453A is larger than the coverage area of the second circuit contact point 4524. Consequently, the first circuit contact point 4514 of the upper film layer 451 can be contacted with the underlying second circuit contact point 4524 of the lower film layer 452 through the corresponding indented region 453A.

In the key structure 4 of this embodiment, the plural raised structures 44 on the optical film layer 42, the corresponding first circuit contact points 4514 on the upper film layer 451, the corresponding indented regions 453A of the ink layer 453 and the corresponding second circuit contact points 4524 on the lower film layer 452 are aligned with each other along the vertical direction. When the keycap 41 is pressed down, the keycap 41 or the support part 431 of the elastic element 43 is moved downwardly to push at least one of the plural raised structures 44. Consequently, the first circuit contact point 4514 corresponding to the pushed raised structure 44 and the second circuit contact point 4524 corresponding to the pushed raised structure 44 are contacted with each other. Under this circumstance, the key structure 4 induces, generates or outputs a pressing signal.

As mentioned above, the position near each of the four corners 421A and the four edges 421B of the light-transmissible region 421 in the optical film layer 42 is equipped with at least one raised structure 44. Similarly, the position near each of the four corners 4512A and the four edges 4512B of the first opening 4512 in the upper film layer 451 is equipped with at least one first circuit contact point 4514. Similarly, the position near each of the four corners 4522A and the four edges 4522B of the second opening 4522 in the lower film layer 452 is equipped with at least one second circuit contact point 4524.

Due to the above structural design, the drawbacks of the conventional technologies can be overcome. For example, even if the pressing force is not applied to the middle region of the keycap 41, for example the pressing force is applied to an edge or a corner of the keycap 41, it is assured that the first circuit contact point 4514 of the upper film layer 451 can be contacted with the underlying second circuit contact point 4524 of the lower film layer 452. Consequently, the underlying membrane switch 45 can be effectively triggered.

In the triggering structure of this embodiment, the ink layer 453 formed by using the UV printing process. Consequently, when there is a need to change the design or meet the size specifications of various products, the area or the size of the indented region 453A can be modified or adjusted more easily.

In the first embodiment, the ink layer 453 is formed and cured on the first bottom surface 4513 of the upper film layer 451 individually, or the ink layer 453 is cured and formed on the second top surface 4521 of the lower film layer 452 individually. It is noted that numerous modifications may be made while retaining the teachings of the present invention. For example, in another embodiment, two ink layers 453 are formed and cured on both of the first bottom surface 4513 of the upper film layer 451 and the second top surface 4521 of the lower film layer 452.

Figure 9:
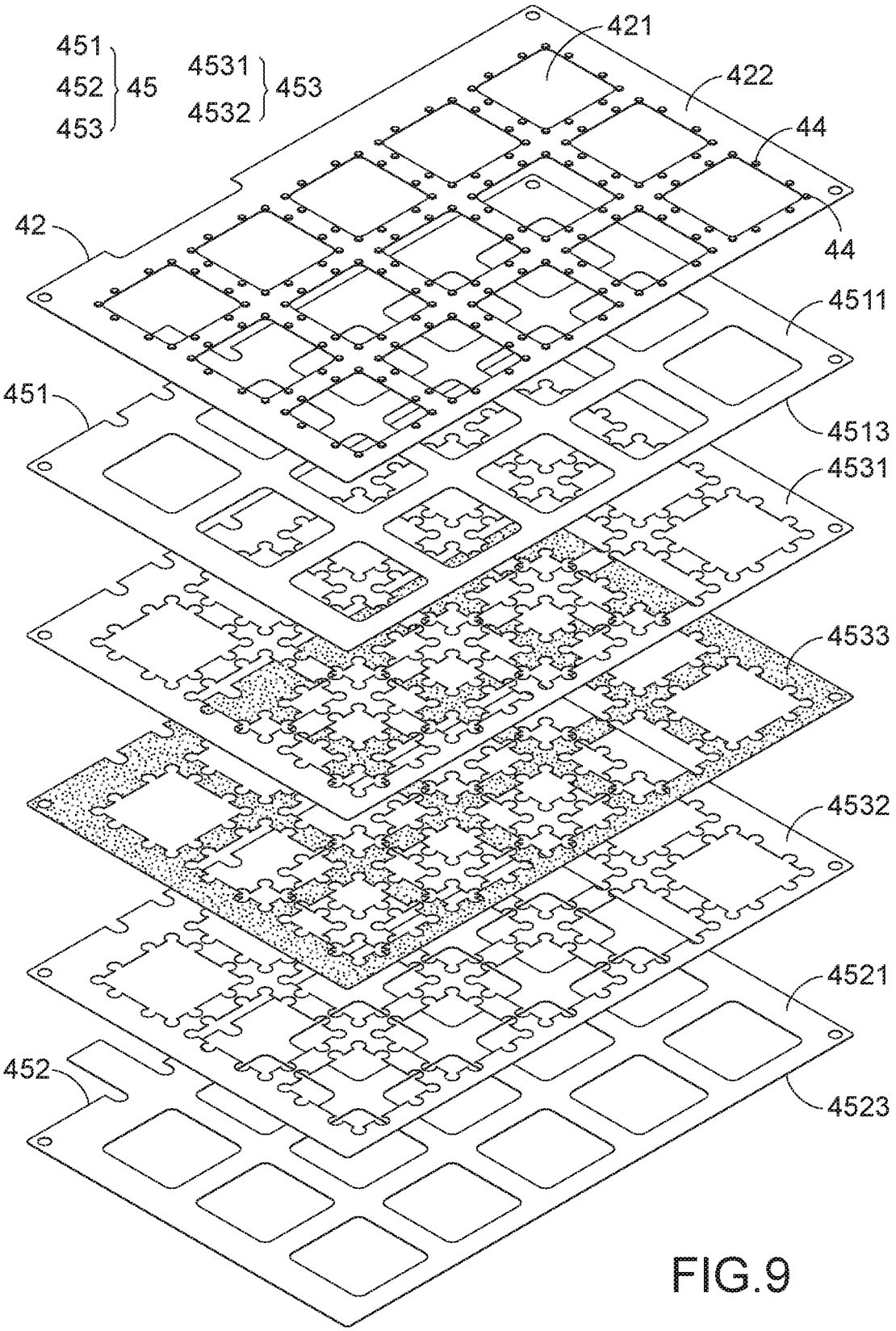
FIG. 9 is a schematic exploded view illustrating the optical film layers and the membrane switches of plural key structures in a control device according to a second embodiment of the present invention.

FIG. 9 is a schematic exploded view illustrating the optical film layers and the membrane switches of plural key structures in a control device according to a second embodiment of the present invention. In the membrane switch 45 of this embodiment, a first ink layer 4531 is formed and cured on the first bottom surface 4513 of the upper film layer 451, and a second ink layer 4532 is formed and cured on the second top surface 4521 of the lower film layer 452. The first ink layer 4531 and the second ink layer 4532 are contacted with each other along the vertical direction. Optionally, the membrane switch 45 further comprises an adhesive layer 4533. The adhesive layer 4533 is arranged between the first ink layer 4531 and the second ink layer 4532. The first ink layer 4531 and the second ink layer 4532 are combined together through the adhesive layer 4533.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A control device, comprising:

a display panel; and plural key structures located over the display panel, wherein each of the plural key structures comprises:

a keycap, wherein the keycap is light-transmissible;

an optical film layer comprising a light-transmissible region and a supporting region;

an elastic element arranged between the keycap and the optical film layer, wherein the elastic element comprises a support part, a first lateral wall, a first lower part and a hollow part, wherein the support part, the first lateral wall and the first lower part are arranged around the hollow part, the support part is connected with the keycap, and the first lateral wall is arranged between the support part and the first lower part;

plural raised structures formed on the supporting region of the optical film layer and arranged around the light-transmissible region of the optical film layer; and a membrane switch located under the optical film layer, and comprising an upper film layer, a lower film layer and at least one ink layer, wherein the upper film layer comprises a first top surface, a first opening, a first bottom surface and plural first circuit contact points, and the lower film layer comprises a second top surface, a second opening, a second bottom surface and plural second circuit contact points, wherein the first opening runs through the first top surface and the first bottom surface, the first bottom surface faces the lower film layer, and the plural first circuit contact points are formed on the first bottom surface, wherein the second opening runs through the second top surface and the second bottom surface, the second top surface faces the upper film layer, and the plural second circuit contact points are formed on the second top surface, wherein a light beam emitted by the display panel is transmitted upwardly through the second opening, the first opening, the light-transmissible region, the hollow part and the keycap, wherein the at least one ink layer is formed on the first bottom surface or the second top surface, and the upper film layer and the lower film layer are separated from each other through the at least one ink layer, wherein each of the at least one ink layer comprises plural indented regions, wherein the plural raised structures, the corresponding first circuit contact points, the corresponding indented regions and the corresponding second circuit contact points are aligned with each other along a vertical direction, wherein when the keycap is pressed down, the keycap or the support part of the elastic element is moved downwardly to push at least one raised structure of the plural raised structures, so that the first circuit contact point corresponding to the pushed raised structure and the second circuit contact point corresponding to the pushed raised structure are contacted with each other.

2. The control device according to claim 1, wherein the light-transmissible region of the optical film layer is a rectangular opening with four corners and four edges, wherein in each of the plural key structures, each of the four corners and the four edges of the light-transmissible region is located near at least one corresponding raised structure of the plural raised structures.

3. The control device according to claim 1, wherein the first opening is a rectangular opening with four corners and four edges, wherein in each of the plural key structures, each of the four corners and the four edges of the first opening is located near at least one corresponding first circuit contact point of the plural first circuit contact points.

4. The control device according to claim 1, wherein the first opening is a rectangular opening with four corners and four edges, wherein each of the four corners and the four edges of the first opening is located near at least one corresponding indented region of the plural indented regions of the corresponding ink layer.

5. The control device according to claim 1, wherein an coverage area of each indented region is larger than an coverage area of the corresponding first circuit contact point, so that the corresponding first circuit contact point is permitted to be contacted with the underlying second circuit contact point through the corresponding indented region.

6. The control device according to claim 1, wherein each indented region has an arc-shaped notch.

7. The control device according to claim 1, wherein the second opening is a rectangular opening with four corners and four edges, wherein in each of the plural key structures, each of the four corners and the four edges of the second opening is located near at least one corresponding second circuit contact point of the plural second circuit contact points.

8. The control device according to claim 1, wherein the second opening is a rectangular opening with four corners and four edges, wherein each of the four corners and the four edges of the second opening is located near at least one corresponding indented region of the plural indented regions of the corresponding ink layer.

9. The control device according to claim 1, wherein the at least one ink layer is formed on the first bottom surface or the second top surface by using a UV printing process.

10. The control device according to claim 1, wherein the at least one ink layer includes a first ink layer and a second ink layer, wherein the first ink layer is formed on the first bottom surface, the second ink layer is formed on the second top surface, and the first ink layer and the second ink layer are contacted with each other along the vertical direction.

11. The control device according to claim 1, wherein the at least one ink layer includes a first ink layer and a second ink layer, wherein the first ink layer is formed on the first bottom surface, the second ink layer is formed on the second top surface, and the first ink layer and the second ink layer are combined together through an adhesive layer.

12. The control device according to claim 1, wherein the optical film layer is a light-shielding sheet, and the light-transmissible region of the optical film layer is a hollow structure.

13. The control device according to claim 1, wherein the raised structures are made of rubber, epoxy resin or polyester resin.

14. The control device according to claim 1, wherein the raised structures are formed by using an attaching process, a printing process, a coating process, a glue dispensing process or an integral formation process.

15. The control device according to claim 1, wherein the keycap comprises a press part, a second lateral wall and a second lower part, wherein the second lateral wall is arranged between the press part and the second lower part, and the second lower part is downwardly contacted with the support part of the elastic element, wherein when the keycap is pressed down, the support part of the elastic element is moved downwardly to push at least one raised structure of the plural raised structures.

* * * * *